United States Patent [19]

Nakayama et al.

[11] Patent Number: 4,607,002

[45] Date of Patent: Aug. 19, 1986

[54] SILVER HALIDE COLOR PHOTO-SENSITIVE MATERIAL

[75] Inventors: Noritaka Nakayama; Satoshi Kawakatsu; Katsunori Katoh, all of Hachioji; Kaoru Shinozaki, Tachikawa, all of Japan

[73] Assignee: Konishiroku Photo Industry Co., Ltd., Japan

[21] Appl. No.: 797,991

[22] Filed: Nov. 14, 1985

[30] Foreign Application Priority Data

Nov. 15, 1984 [JP] Japan ..... 59-243007

[51] Int. Cl.[4] ..... G03C 1/40; G03C 1/46

[52] U.S. Cl. ..... 430/505; 430/553; 430/556; 430/557; 430/558

[58] Field of Search ..... 430/558, 553, 557, 556, 430/505

[56] References Cited

U.S. PATENT DOCUMENTS

| | | | |
|---|---|---|---|
| 3,725,067 | 4/1973 | Bailey et al. | 430/558 |
| 4,338,393 | 7/1982 | Bailey et al. | 430/558 |
| 4,456,681 | 6/1984 | Kadowaki et al. | 430/557 |
| 4,481,268 | 11/1984 | Bailey et al. | 430/17 |
| 4,510,691 | 4/1985 | Matsuzaka et al. | 430/557 |
| 4,529,691 | 7/1985 | Renner et al. | 430/557 |
| 4,548,899 | 10/1985 | Nakayama et al. | 430/558 |

OTHER PUBLICATIONS

U.S. patent application Ser. Nos. 797,974, and 798,116, Nakayama et al.

*Primary Examiner*—Richard L. Schilling
*Attorney, Agent, or Firm*—Finnegan, Henderson, Farabow, Garrett & Dunner

[57] ABSTRACT

A silver halide color photographic light-sensitive material comprising a reflective support bearing thereon a green light-sensitive silver halide emulsion layer containing a t-alkyl 1H-pyrazolo[3,2-C]-5-triazole magenta forming coupler represented by Formula (I) defined in the specification: a blue light-sensitive silver halide emulsion layer containing a t-butyl acylacetamide yellow-forming coupler represented by Formula (II) defined in the specification and a red light-sensitive silver halide emulsion layer containing a phenolic cyan-forming coupler represented by Formula (III) or (IV) defined in the specification.

6 Claims, No Drawings

SILVER HALIDE COLOR PHOTO-SENSITIVE MATERIAL

BACKGROUND OF THE INVENTION

This invention relates to a silver halide color photo-sensitive material capable of displaying a high color-developability and producing an image having a high preservability and in particular an excellent color-fastness to light.

Generally, in a silver halide color photo-sensitive material, a dye-image may be obtained in such a manner that exposed silver halide grains are reduced by making use of an aromatic primary amine color developing agent and the resulting oxidation products of the above-mentioned color developing agent which are to be produced in the instance are coupled to the couplers for producing yellow, magenta or cyan dyes, respectively.

There are generally known an open-chained keto-methylene yellow coupler for forming the above-mentioned yellow dyes; a pyrazolone magenta coupler and an 1H-pyrazolo[3,2-c]-s-triazole magenta coupler for forming the magenta dyes; and a phenol cyan coupler, a naphthol cyan coupler or the like for forming the cyan dyes.

Such couplers as mentioned above and the dyes obtained therefrom shall satisfy various requirements when they are to be put into practical use. The couplers, for example, are required to be as high as possible in the coupling rate, i.e., the color developability, when they couples to the oxidation products of a color developing agent; and the couplers and the dyes obtained therefrom are required to be stable for a long preservation and in particular against light, i.e., a color-fastness to light; and, the couplers are also required to be as low as possible in unnecessary side or collateral absorption.

If the above-mentioned requirements should be satisfied by only some part of the yellow, magenta and cyan coulers, the unbalanced colors will come out. It is, therefore, required that the requirements are to be satisfied in the state where all the three kinds of couplers are in combination.

The conventional dyes produced of yellow, magenta or cyan couplers have so far been disadvantageous in that the color fastness to light thereof is unsatisfactory and the unbalance of colors are caused by the irradiation of light for a long time because the three kinds of dyes are different from each other in the color fastness to light.

SUMMARY OF THE INVENTION

It is an object of the invention to provide a silver halide color photo-sensitive material not only capable of keeping the stability thereof in a long-time preservation and in particular the color-balance even when it is irradiated by light for a long time, but also capable of displaying an excellent color developability thereof.

The above-mentioned object of the invention can be attained by a silver halide color photo-sensitive material comprising a reflective support bearing thereon a green-sensitive silver halide emulsion layer containing a magenta coupler having the following Formula (I), a blue-sensitive silver halide emulsion layer containing a yellow coupler having the following Formula (II), and a red-sensitive silver halide emulsion layer containing a cyan coupler having the following Formula (III) or (IV).

Formula (I)

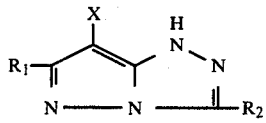

wherein $R_1$ represents a tertiary alkyl group; $R_2$ represents an alkyl group or an aryl group; and X represents a split-off group other than hydrogen, which is capable of splitting off through a reaction with the oxidation products of a color developing agent.

Formula (II)

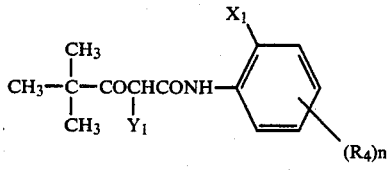

wherein $X_1$ represents a halogen, an alkoxy group or an alkyl group; $Y_1$ represents a group capable of splitting off when a dye is formed by coupling the group with the oxidation products of an aromatic primary amine color developing agent; $R_4$ represents a group substitutable to a benzene ring; and n is an integer of 1 or 2.

Formula (III)

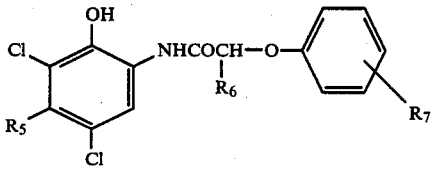

wherein $R_5$ represents an alkyl group having 1 to 4 carbon atoms; $R_6$ represents hydrogen or an alkyl group having 1 to 15 carbon atoms; and $R_7$ represents a halogen, an alkyl group, a hydroxy group or an acyloxy group.

Formula (IV)

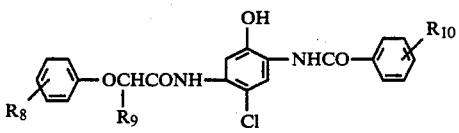

wherein $R_8$ represents an alkyl group, a halogen, a sulfonamido group, a sulfamoyl group, an arylsulfonyl group, or a hydroxy group; $R_9$ represents hydrogen or an alkyl group; and $R_{10}$ represents hydrogen, a halogen, an alkyl group, a sulfamoyl group or a sulfonamido group.

DETAILED DESCRIPTION OF THE INVENTION

Now, the invention will detailedly be described.

The magenta couplers of the invention can be represented by the following Formula (I);

Formula (I)

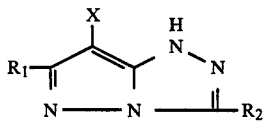

wherein $R_1$ represents a tertiary alkyl group; $R_2$ represents an alkyl group or an aryl group; and X represents a split-off group other than hydrogen, which is capable of splitting off through a reaction with the oxidation products of a color developing agent.

The tertiary carbon atom of the tertiary alkyl group represented by $R_1$ is allowed to be substituted by, instead of an alkyl group, such an aryl group as a phenyl group, or an alkoxy group or the like. In addition, the tertiary carbon atom is allowed to participate also in the formation of another cyclic group. Furthermore, an alkyl group attached to tertiary carbon atom is allowed to be substituted by a halogen atom, an alkoxy group, or the like.

Such tertiary alkyl groups as above substantially include tert-butyl, 1,1-dimethyl-2-methoxyethyl, 1,1-dimethyl-2-chloroethyl, 1-methyl-1-methoxyethyl, 1-methyl-1-phenylethyl, 1,1-di-n-amylhexyl, 7,7-dimethylnorbornan-1-yl, 1,1-dimethylbutyl, 1-ethyl-1-methylpropyl, and adamantyl groups.

The alkyl group represented by $R_2$ is allowed to be a methyl, primary alkyl, or branched secondary or tertiary alkyl group. The primary alkyl group represents an alkyl group in which two hydrogen atoms are coupled to a base carbon; the secondary alkyl group represents an alkyl group in which one hydrogen atom is coupled to a base carbon; and the tertiary alkyl group represents an alkyl group in which no hydrogen atom is coupled at all to a base carbon. An alkyl group represented by $R_2$ is allowed to be substituted by an aryl group, heterocyclic group, a halogen atom, cyano group; substituents linked through a carbonyl group such as alkoxycarbonyl, acyl or carbamoyl groups; and substituents linked through a hetero atom such as nitro, alkoxy, alkylthio, arylthio, alkylsulfonyl, arylsulfonyl, alkylsulfinyl, arylsulfinyl and dialkylamino groups. However, such a substituent group is especially preferably selected from among alkylthio, arylthio, alkylsulfonyl, arylsulfonyl, alkylsulfinyl, and arylsulfinyl groups. An aryl group represented by $R_2$ is preferably a phenyl group.

Further, needless to say, magenta-forming couplers in the invention include also bis-type 1H-pyrazolo[3,2-c]-s-triazole compounds, which are formed when the heterocyclic residue is a 1H-pyrazolo[3,2-c]-s-triazole-3-yl residue.

The split-off group represented by X is allowed to be a halogen atom, or an organic group linked in a coupling position, through an oxygen, nitrogen, or sulfur atom.

Among such split-off group, those linked through an oxygen atom include alkoxy, aryloxy, acyloxy, and heteroclycloxy groups. Those linked, in the coupling position, an nitrogen atom include acylamino, diacylamino, and sulfonamido groups, and the nitrogen-containing 5- or 6-membered heterocyclic groups. Those linked, in the coupling position, through an sulfur atom include thiocyano, alkylthio, arylthio, heterocyclothio, arylsulfonyl, and alkylsulfonyl groups.

Exemplary compounds represented by Formula (I) are listed below.

Exemplary compounds (1) to (24):

(1)

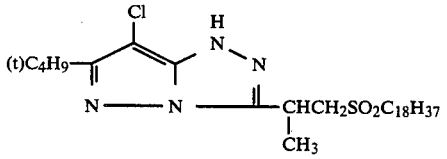

(2)

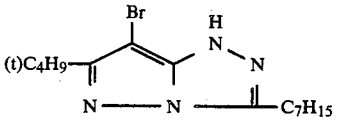

(3)

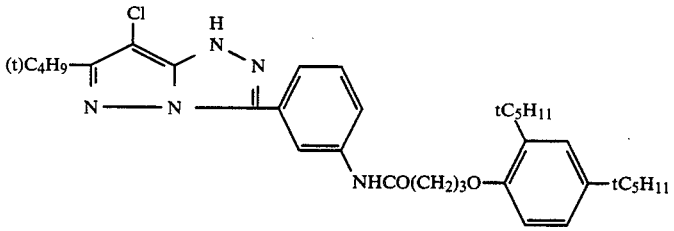

(4)

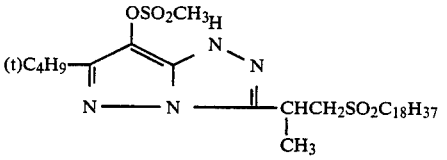

(5)

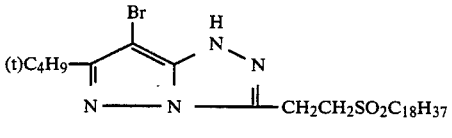

(6)

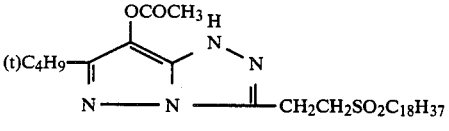

(7)

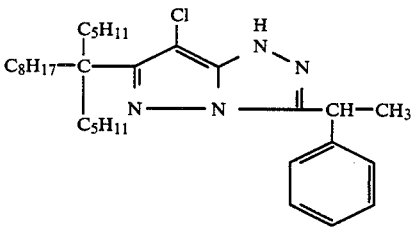

-continued
Exemplary compounds (1) to (24):
(8)
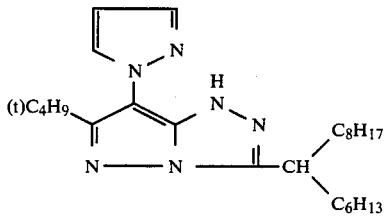
(9)
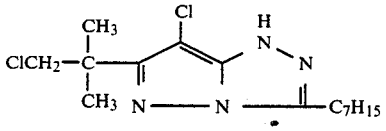
(10)
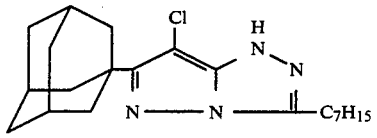
(11)
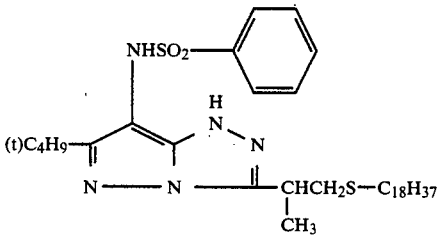
(12)
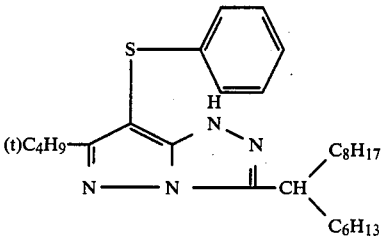
(13)
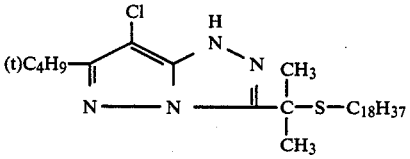
(14)
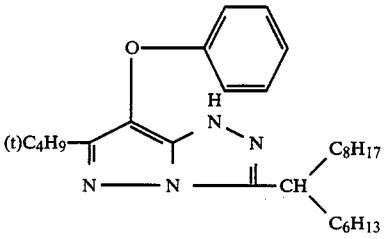
(15)
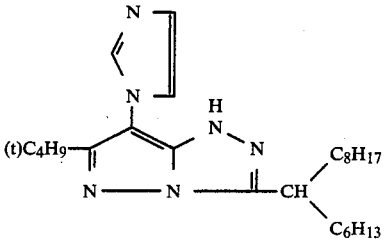
(16)
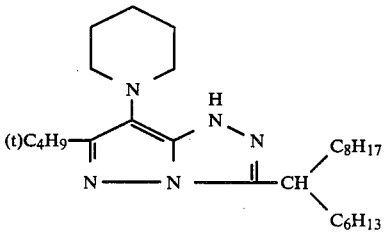
(17)
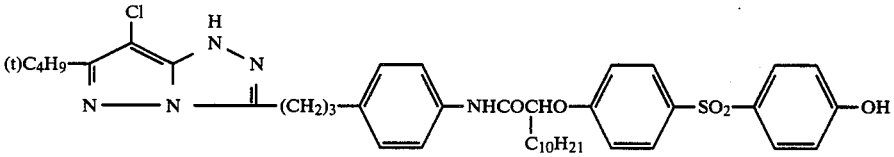
(18)
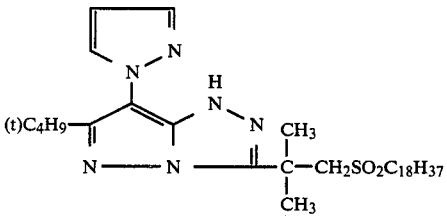
(19)
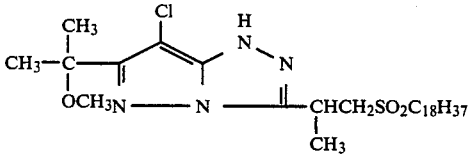

-continued

Exemplary compounds (1) to (24):

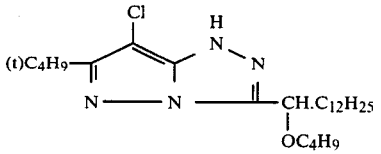
(20)

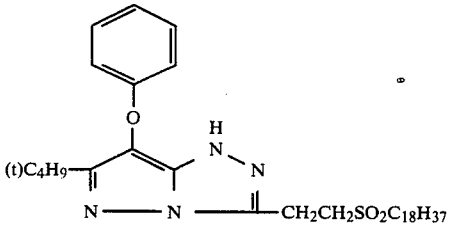
(21)

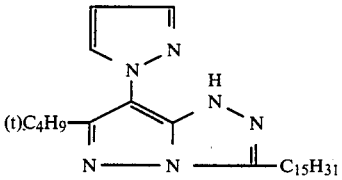
(22)

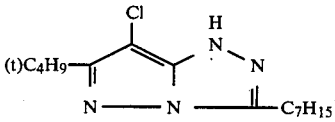
(23)

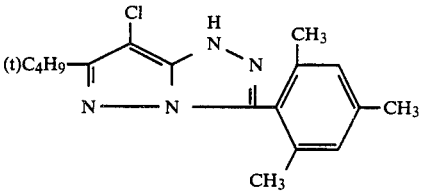
(24)

Description of typical synthetic processes of the above couplers of the invention is given below. The experimental synthesis was carried out on referring to the descriptions in Research Disclosure, No. 12443; Journal of the Chemical Society, Perkin I, 1977, P. 2047–2052; U.S. Pat. No. 3,725,067; and Japanese Patent O.P.I. Publication No. 99437/1984. Synthesis of Exemplary Compound (1):

The reaction scheme of the synthesis of Exemplary Compound (1) is represented as follows:

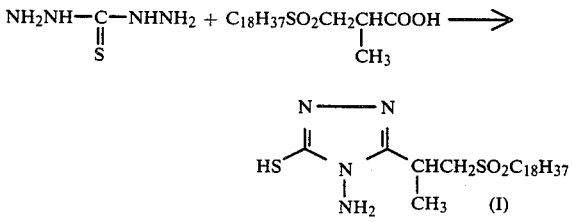

(I) + $tC_4H_9COCH_2Br$ ⟶

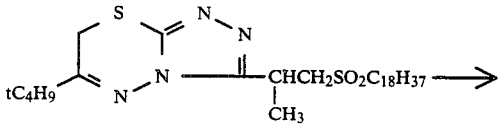
(II)

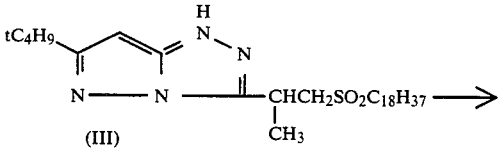
(III)

-continued

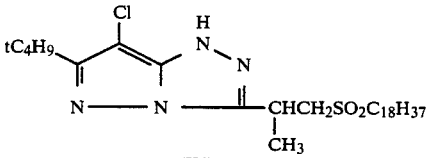
(IV)

SYNTHESIS OF (I)

Seventy grams (70 g) of 1-methyl-2-octadecylsulfonylpropionic acid, and 10 g of thiocarbohydrazide are refluxed for about 30 minutes in methyl cellosolve solution. After cooling, precipitated crystals are filtered off, and recrystallized from an ethanol/water mixed solvent to obtain (I).

SYNTHESIS OF (II)

A solution of 8.8 g of (I), and 3.6 g of tert-butyl bromomethyl ketone in 200 ml of ethanol is boiled for 6 hours under stirring. After cooling, precipitated crystals are filtered off, and dissolved into methanol. After adjusting $_pH$ of the solution to 8 by adding 10% sodium carbonate solution, precipitated crystals are filtered off, and washed well. Obtained crystals are recrysallized from ethanol containing a small amount of water to obtain (II).

SYNTHESIS OF (III)

Six grams (6 g) of (II) is dispersed into 500 ml of n-dodecane, and boiled for 3 hours in a stream of nitrogen under stirring. After cooling, precipitated solid matter is filtered off and recrystallized from acetonitrile.

SYNTHESIS OF (IV)

Three grams (3 g) of (III) is dissolved into chloroform, added to with the equivalent quantity of N-chlorosuccinimide, and made to react together at 20° C. for 30 minutes. Then, the resulting mixture is washed with dilute alkali solution to remove by-produced succinimide. After distilling away of chloroform, the residue is purified by column chromatography using silica gel carrier, and benzene/acetone developing solvent. The product is identified as exemplary compound (1) with nuclear magnetic resonance spectrometry.

Other 1H-pyrazolo[3,2-c]-s-triazole residues without X as a split-off group were synthesized according to similar manners to those in the above synthesis of (I).

Exemplary Compounds (4), (6), (12), (14) and (21) were synthesized according to the description in U.S. Pat. No. 3,725,067. Exemplary Compounds (8), (11), (15), (16), (18) and (22) were synthesized on referring to the general synthetic method described in Japanese Patent O.P.I. Publication No. 99437/1984.

The yellow-developing couplers of the invention can be represented by the following Formula (II);

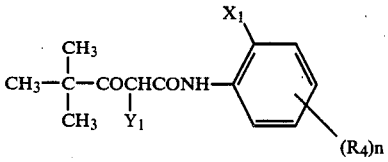

Formula (II)

where $X_1$ is a halogen atom such as a chlorine atom; an alkoxy group such as a methoxy group, and a ethoxy group; or an alkyl group such as a methyl group, and a ethyl group. $Y_1$ is a group (a split-off component) which is splitted-off, when the coupler couples to the oxidation product of a color developing agent of aromatic primary amine type to form a dye. $Y_1$ is preferably an aryloxy group, a heterocycloxy group, or the following group:

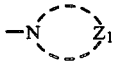

where $Z_1$ represents a group of atoms which is selected from carbon, oxygen, nitrogen and sulfur atoms, so as to form a 5- or 6-membered ring with the nitrogen atom in this formula; $R_4$ represents a substitutable group attachable to the benzene ring; and n is 1 or 2, provided that $R_4$ is allowed to be either the same or different when n is 2.

$R_4$ is a halogen atom (for example, F, Cl or Br), or one of the following groups;

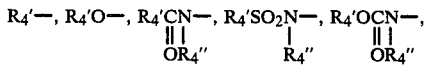

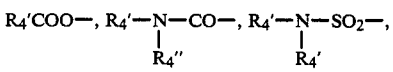

-continued

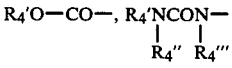

where $R_4'$, $R_4''$ and $R_4'''$ are allowed to be the same with or different from each other, and each of them represents a hydrogen atom or, alkyl group, aryl group, or heterocyclic group (each group is allowed to have a substituent). They are preferably $R_4'$ CONH—, $R_4'SO_2NH$—, or $R_4'OCONH$— (where $R_4'$ is an alkyl group, and allowed to have a substituent). They are most preferably $R_4'CONH$—, where $R_4'$ is an alkyl group having a substituent.

When $Y_1$ is an aryloxy group, the aryl portion thereof is preferably the phenyloxy group which is allowed to have a substituent. Thus, the aryloxy group is substantially a phenoxy, 4-carboxyphenyloxy, 4-(4-benzyloxybenzenesulfonyl)-phenyloxy group or the like. When $Y_1$ is a heterocycloxy group, it is a 1-phenyl-5-tetrazolyloxy group, isoxazolyloxy group, or 4-pyridinyloxy group, for example.

When $Y_1$ is a group represented by

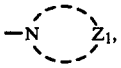

it is one of the following groups, for example:

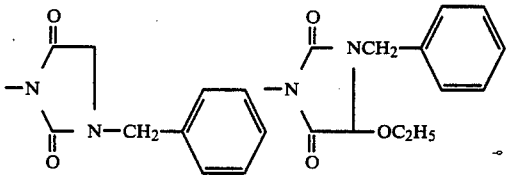

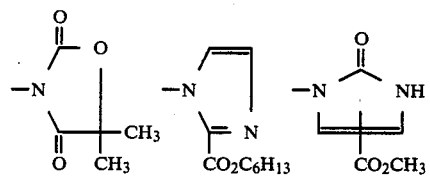

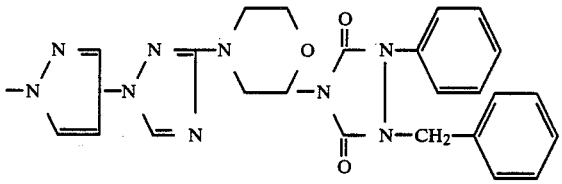

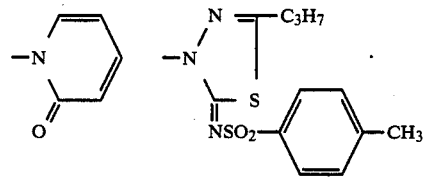

Typical compounds used as the yellow-developing couplers represented by Formula (II) are listed as follows;

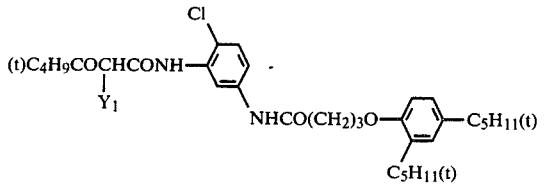
Y1
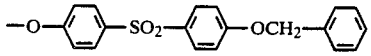
Y-1
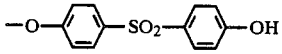
Y-2
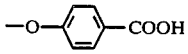
Y-3
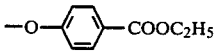
Y-4
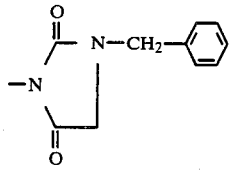
Y-5
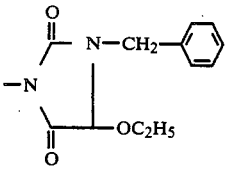
Y-6
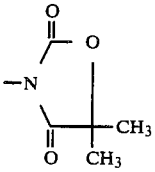
Y-7
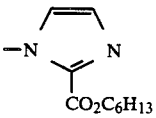
Y-8
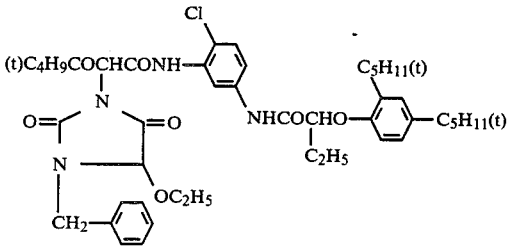
Y-9
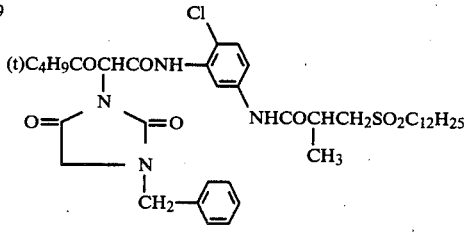
Y-10
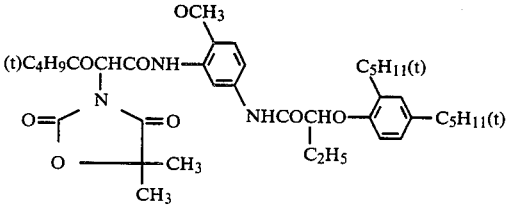
Y-11
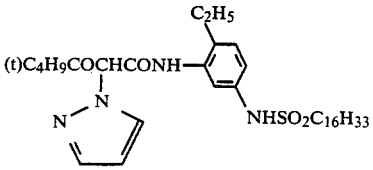
Y-12
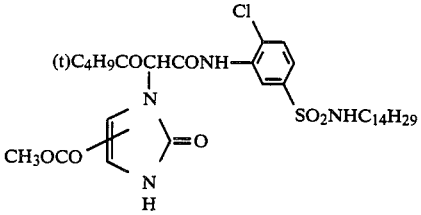
Y-13
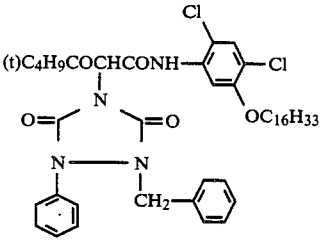
Y-14

-continued
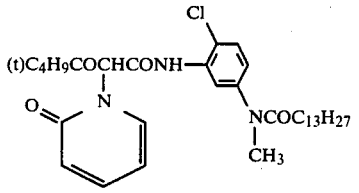
Y-15
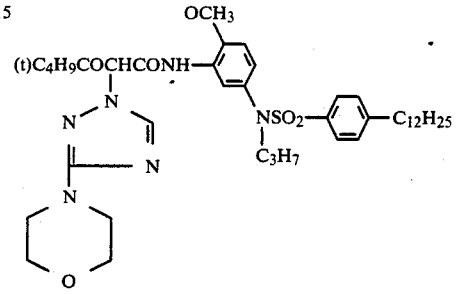
Y-16
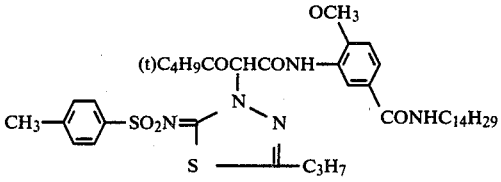
Y-17
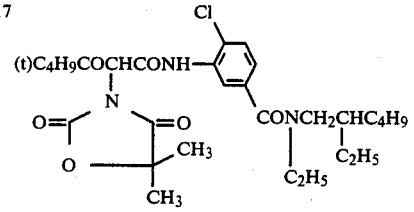
Y-18
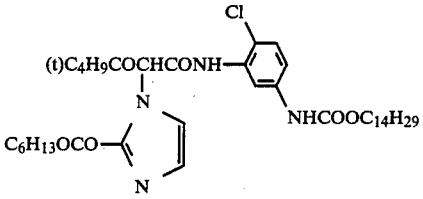
Y-19
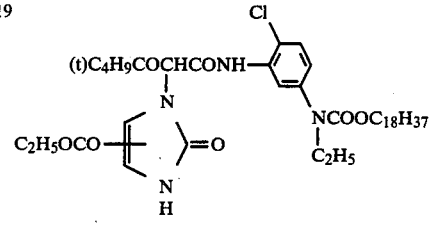
Y-20
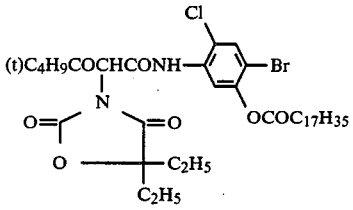
Y-21
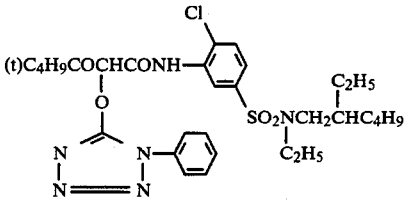
Y-22
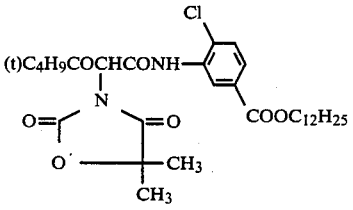
Y-23
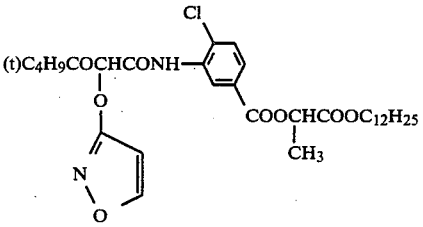
Y-24
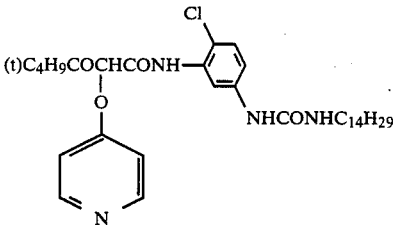
Y-25
The splitting-off component of the most suitable yellow-developing coupler which is used in combination with a magenta-developing coupler of the invention is preferably groups represented by:
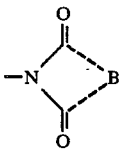

where B represents a group atoms necessary for forming a 5-membered ring with the combination of carbon-nitrogen or carbon-oxygen interposed between two carbonyl groups. Then the split-off component of the group is preferably the above Y-5, Y-6, Y-7 or Y-21, for example.

The split-off components of Y-1, Y-8, and Y-13 also are preferable for displaying the same effects, but not so great as the above ones.

The yellow developing couplers are preferably the compounds with the above Y-1, Y-5, Y-6, Y-7, Y-8, or Y-9.

The cyan-developing couplers of the invention are represented by the following Formula (III) or (IV);

Formula (III)

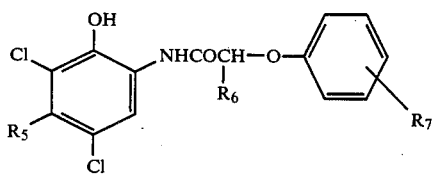

where $R_5$ is a $C_1$ to $C_4$ alkyl group; $R_6$ is a hydrogen atom, or $C_1$ to $C_{15}$ alkyl group. $R_7$ is a halogen atom, alkyl group, hydroxy group, or acyloxy group, or, in addition a combination of two or more of them in case of polysubstitution. The position of $R_7$ on the benzene ring is not specified.

The $C_1$ to $C_4$ alkyl group represented by $R_5$ is substantially a methyl, ethyl, propyl, isopropyl, or butyl group.

The $C_1$ to $C_{15}$ alkyl group represented by $R_6$ is a straight or branched alkyl chain, and is substantially a methyl, ethyl, propyl, isopropyl, butyl, octyl, decyl, dodecyl group, or the like.

When $R_7$ is a halogen atom, it is preferably chlorine. When $R_7$ is an alkyl group, it is allowed to be either aliphatic or alicyclic, and substantially a pentadecyl, tert-amyl, cyclopentyl group, or the like. When $R_7$ is an acyloxy group, it is preferably an aliphatic acyloxy group.

When $R_7$ represents a combination if two or more groups, the combination of substitution is 2,4-di-tert-butyl; 2,4-di-tert-acyl; 4-chloro-2-(1-methyl-tridecyl); 2-pentyl-4-tert-butyl; or 4-hydroxy-3-tert-butyl, for example.

Formula (IV)

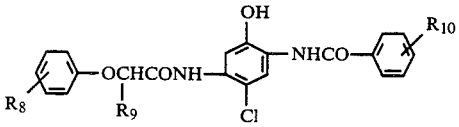

where $R_8$ is a halogen atom, or an alkyl, sulfonamido, sulfamoyl, arylsulfonyl, or hydroxy group; $R_9$ is a hydrogen atom, or an alkyl group; $R_{10}$ is a hydrogen or halogen atom, or an alkyl, sulfamoyl, or sulfonamido group.

The position of $R_8$ on the benzene ring is not specified. Such is also the case in $R_{10}$.

The alkyl group represented by $R_8$ is allowed to be either aliphatic or alicyclic, and is substantially a tert-butyl, tert-amyl, pentadecyl, or cyclopentyl group, for example.

The halogen atom represented by $R_8$ is allowed to be chlorine, bromine, or fluorine, but is preferably chlorine.

When $R_8$ represents a sulfonamido group, it is an alkylsulfonamido group, or an arylsulfonamido (preferably substituted or unsubstituted phenylsulfonamido) group. The alkylsulfonamido group is preferably an aliphatic alkylsulfonamido group.

When $R_8$ represents a sulfamoyl group, it is an alkylsulfamoyl, dialkylaminosulfamoyl, or arylsulfamoyl (preferably substituted or unsubstituted phenylsulfamoyl) group. Said alkylsulfamoyl group is preferably an aliphatic alkylsulfamoyl group. The dialkylaminosulfamoyl group is substantially a dimethylaminosulfamoyl group, for example.

In the arylsulfonyl group represented by $R_8$, the aryl group is preferably a phenyl group. Then the arylsulfonyl group is especially preferably a p-hydroxyphenylsulfonyl group, for example.

The alkyl group represented by $R_9$ is a straight or branched alkyl chain, and is substantially a methyl, ethyl, propyl, isopropyl, butyl, octyl, decyl or dodecyl group, for example.

When $R_{10}$ is a halogen atom, it is allowed to be chlorine, bromine, or fluorine, but is preferably chlorine or fluorine.

The alkyl group represented by $R_{10}$ is a straight or branched alkyl chain.

When $R_{10}$ represents a sulfonamido group, it is an alkylsulfonamido group, or an arylsulfonamido (preferably substituted or unsubstituted phenylsulfonamido) group. The alkylsulfonamido group is preferably an alphatic alkylsulfonamido group.

When $R_{10}$ represents a sulfamoyl group, it is an alkylsulfamoyl group, or an arylsulfamoyl (preferably substituted or unsubstituted phenylsulfamoyl) group. The alkylsulfamoyl group is preferably an aliphatic alkylsulfamoyl group.

Exemplary compounds represented by the Formula (III) is listed as follows.

C-(I)-1

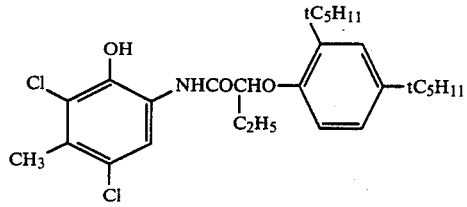

C-(I)-2

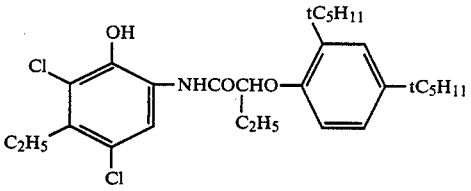

C-(I)-3

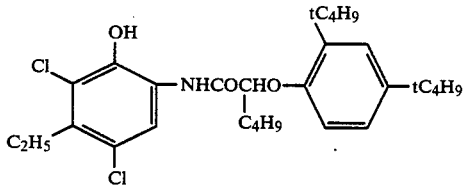

-continued
C-(I)-4
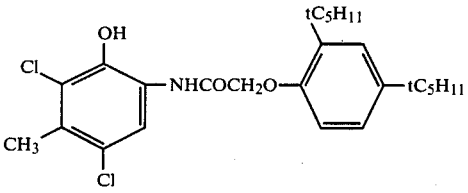
C-(I)-5
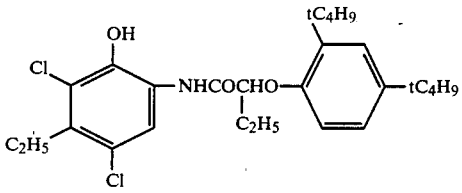
C-(I)-6
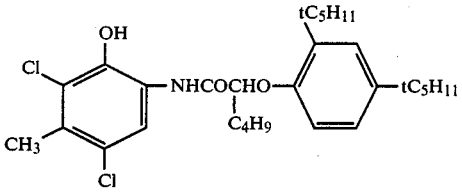
C-(I)-7
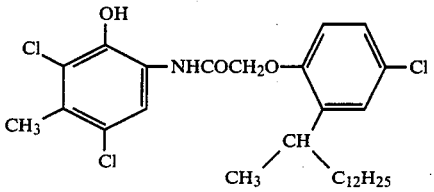
C-(I)-8
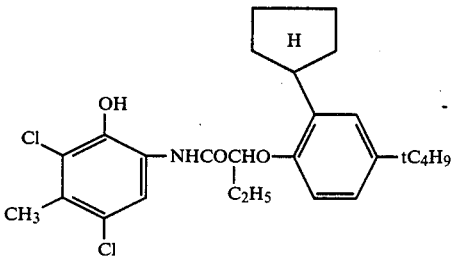
-continued
C-(I)-9
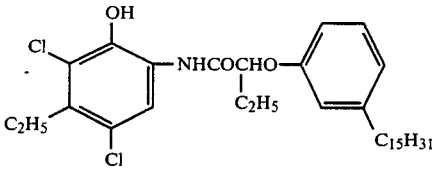
C-(I)-10
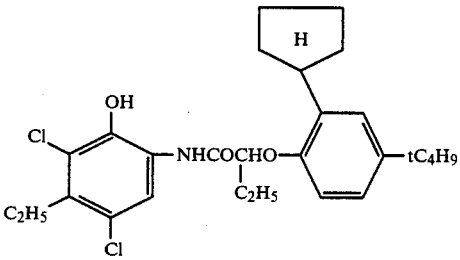
C-(I)-11
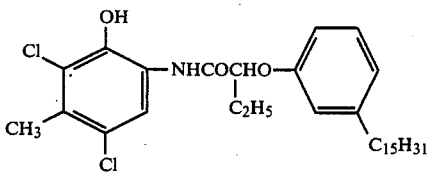
C-(I)-12
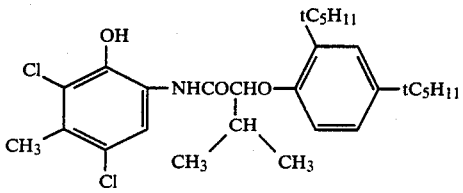
Exemplary compounds represented by the Formula (IV) is listed as follows:
C-(II)-1
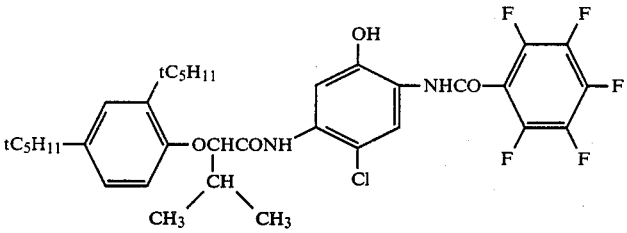
C-(II)-2
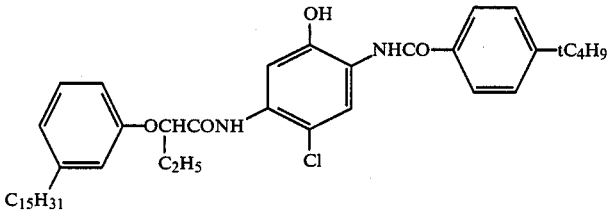
C-(II)-3
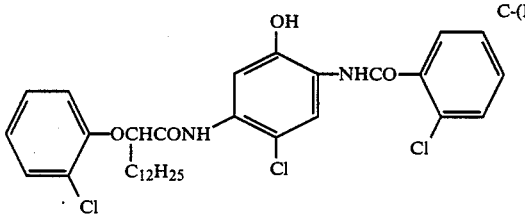

-continued

C-(II)-4

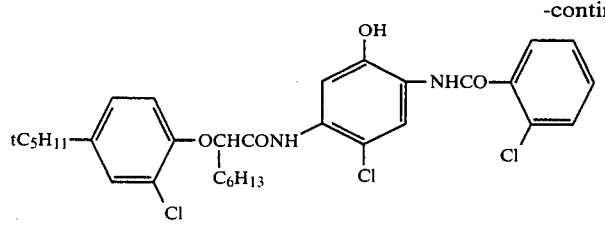

C-(II)-5

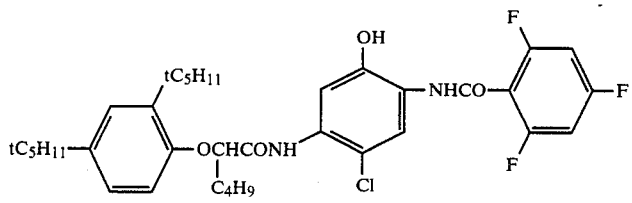

C-(II)-6

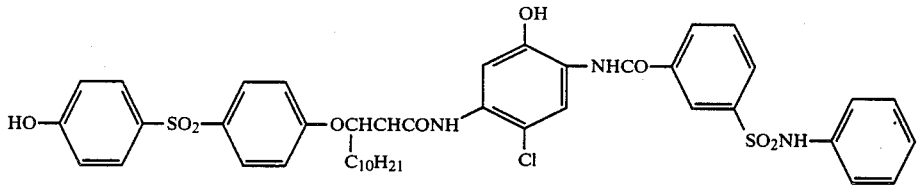

C-(II)-7

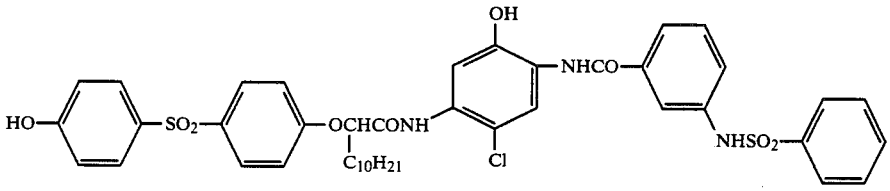

C-(II)-8

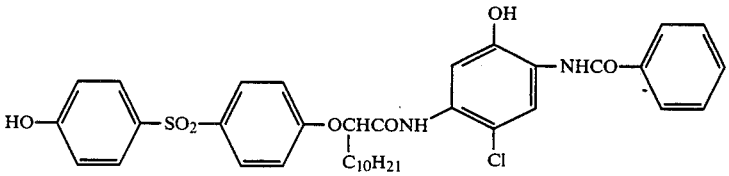

C-(II)-9

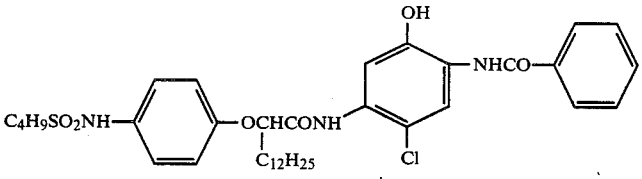

C-(II)-10

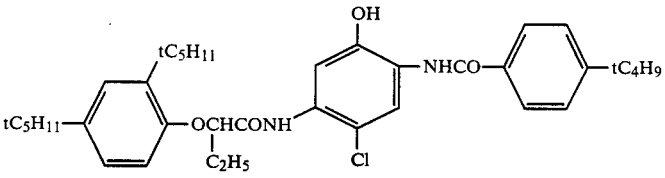

The cyan-developing couplers represented by Formula (III) or (IV) are allowed to be used either singly each or in combination with each other.

As magenta-developing coupler, each of couplers of the invention is allowed to be used either singly or in combination of two or more kinds. In addition, it is allowed to be used in combination with a well-known conventional couplers selected from among pyrazolone, indazolone, cyanoacetyl, pyrazolinobenzimidazole, and pyrazolotriazole compounds as the case may be.

Further, a certain colored coupler having a color correcting effect, or a certain coupler (DIR coupler) releasing a development inhibitor, is allowed to be used in combination with a coupler of the invention if necessary.

A magenta-forming coupler for the invention, and other couplers used in combination with said magenta-forming coupler are incorporated into a silver halide emulsion layer according to well-known methods including the method described in U.S. Pat. No. 2,322,027.

The couplers are dissolved into, for example, such a solvent as alkyl phthalate such as dibutyl phthalate, and dioctyl phthalate; phosphoric acid ester such as diphenyl phosphate, triphenyl phosphate, tricresyl phosphate, and dioctyl butyl phosphate; citric acid ester such as tributyl acetylcitrate; benzoic acid ester such as octyl benzoate; alkylamide such as diethyllauramide; aliphatic acid ester such as dibutoxyethyl succinate, and dioctyl azelate; trmesic acid ester such as tributyl trimesate; and such an organic solvent boiling at about 30° to 150° C. as ethyl acetate, butyl acetate, ethyl propionate, sec-butyl alcohol, methyl isobutyl ketone, β-ethoxyethyl acetate, and methyl cellosolve acetate, and then dispersed into a hydrophilic colloid. As a solvent, a mixture of a higher-boiling solvent, and a lower-boiling solvent among the above also is allowed to be used.

In addition, the dispersing process with polymer, described in Japanese Patent Examined Publication No. 39853/1976, and Japanese Patent O.P.I. Publication No. 59943/1976, also can be used.

A magenta-forming coupler in the invention is added to a silver halide emulsion usually in the range of 0.005 to 2 moles per mole of silver halide and preferably 0.03 to 0.5 moles per mole of silver halide.

While the dye image formed by a magenta-forming coupler of the invention generally exhibits a strong light-resistance by itself, the light resistance is further improved by means of the combined use of a certain antifading agent, or by the addition of a UV absorber-containing layer on the upper side.

As such an antifading agent, there are cited, for example, hydroquinone derivatives described in U.S. Pat. Nos. 2,360,290, 2,418,613, 2,675,314, 2,701,197, 2,704,713, 2,728,659 2,732,300, 2,735,765, 2,710,801 and 2,816,028, and British Pat. No. 1,363,921; gallic acid derivatives described in U.S. Pat. Nos. 3,457,079 and 3,069,262; p-alkoxyphenol compounds described in U.S. Pat. Nos. 2,735,765, and 3,698,909, and Japanese Patent Examined Publication Nos. 20977/1974 and 6623/1977; p-hydroxyphenol derivatives described in U.S. Pat. Nos. 3,432,300, 3,573,050, 3,574,627 and 3,764,337, and Japanese Patent O.P.I. Publication Nos. 35633/1977, 147434/1977 and 152225/1977, and bisphenol compounds described in U.S. Pat. No. 3,700,455.

As the above UV absorber, there are cited, for example aryl-substituted benzotriazole compounds described, for example, in U.S. Pat. No. 3,533,794; 4-thiozolidone compounds described, for example, in U.S. Pat. Nos. 3,314,794 and 3,352,681; benzophenone compounds described, for example, in Japanese Patent O.P.I. Publication No. 2784/1971; cinnamic acid ester compounds described, for example, in U.S. Pat. Nos. 3,705,805 and 3,707,375; butadiene compounds described, for example, in U.S. Pat. No. 4,045,229; benzoxidole compounds; and compounds described in U.S. Pat. No. 3,499,762, and Japanese Patent O.P.I. Publication No. 48535/1979.

As silver halide used in the silver halide emulsion in the invention, there are cited those used commonly in silver halide emulsions in the art such as silver bromide, silver chloride, silver iodobromide, silver chlorobromide, and silver chloroiodobromide.

Silver halide used in the invention is spectrosensitized by an approximately selected sensitizing dye so as to be provided with the color sensitivity to the light of the required range of wavelength. The sensitizing dyes include cyanine dyes, merocyanine dyes, composite cyanine dyes, composite merocyanine dyes, holopolar cyanine dyes, hemicyanine dyes, styryl dyes, and hemioxonole dyes.

As an especially useful sensitizing days, there are cited those described, for example, in West German Pat. No. 929,080; U.S. Pat. Nos. 2,231,658, 2,493,748, 2,503,776, 2,519,001, 2,912,329, 3,656.959, 3,672,897, 3,694,217, 4,025,349 and 4,046,572; British Pat. No. 1,242,588; and Japanese Patent Examined Publication Nos. 14030/1969 and 24544/1977.

While these sensitizing dyes are allowed to be either singly or in combination, they are often used in combination for the purpose of intensive sensitization, as typically shown, for example, in U.S. Pat. Nos. 2,688,545, 2,977,229, 3,897,060, 3,522,052, 3,527,641, 3,617,293, 3,628,964, 3,666,480, 3,672,898, 3,679,428, 3,703,377, 3,769,301, 3,814,609, 3,837,862 and 4,026,707; British Pat. Nos. 1,344,281 and 1,507,803; Japanese Patent Examined Publication Nos. 4936/1968 and 12375/1978; and Japanese Patent O.P.I. Publication Nos. 110618/1977 and 109925/1977.

Silver halide emulsions used in the invention can contain various well-known photographic additives described, for example, in Research Disclosure, No. 17643.

The support of the silver halide color photo-sensitive material of the invention can be selected from among well-known materials including plastic film, plastic-laminated paper, baryta paper, and synthetic paper, according to the purpose.

The silver halide color photo-sensitive material of the invention can have arbitrarily any layer structure used in the present art.

Thus constituted silver halide color photo-sensitive material of the invention can be submitted to various color developing processings after exposure.

Color developing agents of aromatic primary amine type used in color developers in the invention include well-known compounds being widely used in various color photographic processings. These developing agents include both aminophenol derivatives, and p-phenylenediamine derivatives. In general, these compounds are used in the form of salt such as hydrochloride, and sulfate rather than in the form of free amine, because of more stable nature of the salt. They are usually used at concentrations from about 0.1 to about 30 grams, and preferably from about 1 to about 1.5 grams per liter of developer.

The developing agents of aminophenol type include o-aminophenol, p-aminophenol, 5-amino-2-hydroxytoluene, 2-amino-3-hydroxytoluene, and 2-hydroxy-3-amino-1,4-dimethylbenzenyl, for example. Especially useful color developing agents of aromatic primary amine type are N,N'-dialkyl-p-phenylenediamine compounds, whose alkyl groups and/or phenylene group is allowed to have arbitrary substituent groups. Thus, especially useful compounds include N,N'-diethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)toluene, N-ethyl-N-β-methanesulfonamidoethyl-3-methyl-4-aminoanilane sulfate, N-ethyl-N-β-hydroxyethlaminoaniline, 4-amino-3-methyl-N,N'-diethylaniline, and 4-amino-N-(2-methoxyethyl)-N-ethyl-3-methylaniline p-toluenesulfonate, for example.

A color developer used in processing in the invention is allowed to arbitrarily contain, besides the above color developing agent of aromatic primary amine type, such various additives, which are commonly added to color developers, as sodium hydroxide, sodium carbonate, potassium carbonate, and other alkaline agents; alkali metal sulfites, alkali metal busilfites, alkali metal thiocyanates, alkali metal halides, benzyl alcohol, water-softening agents, and thickening agents. The $_pH$ of the color developer for the invention is usually more than 7.0, and very often about 10 to 13.

After color development, the silver halide photo-sensitive material of the invention is treated by a processing solution capable of fixing the color. When the processing solution is a fixer, the material is preliminarily submitted to a bleaching treatment. A metal complex of organic acid is used as a bleaching agent in the bleaching solution or bleach-fix solution used in the bleaching process. Such a metal complex is capable of oxidizing metallic silver formed through developing process, to silver halide, and of color-developing undeveloped part of the color developing agent at the same time. The metal complex is formed by coordinating such a metal as iron, cobalt, and copper to such an organic acid as aminopolycarboxylic acid, oxalic acid, and citric acid. Such an organic acid is especially preferably a polycarboxylic acid, or aminopolycarboxylic acid. The polycarboxylic acid, or aminopolycarboxylic acid is useful also in the form of its alkali metal or ammonium salt, or water-soluble amine salt.

Thus organic acids, and their salts useful to form metal complexes include the following typical compounds:

(1) Ethylenediaminetetraacetic acid
(2) Diethylenetriaminepentaacetic acid
(3) Ethylenediamine-N-(β-hydroxyethyl)-N,N',N'-triacetic acid
(4) Propylendiaminetetraacetic acid
(5) Nitrilotriacetic acid
(6) Cyclohexanediaminetetraacetic acid
(7) Iminodiacetic acid
(8) Dihydroxyethylglycinecitric acid (or—succinic acid)
(9) Ethyletherdiaminetetraacetic acid
(10) Glycoletherdiaminetetraacetic acid
(11) Ethylenediaminetetrapropionic acid
(12) Phenylenediaminetetraacetic acid
(13) Disodium ethylenediaminetetraacetate
(14) Tetratrimethylammonium ethylenediaminetetraacetate
(15) Tetrasodium ethylenediaminetetraacetate
(16) Pentasodium diethylenetriaminepentaacetate
(17) Sodium ethylenediamine-N-(β-hydroxyethyl)-N,N',N'-triacetate
(18) Sodium propylenediaminetetraacetate
(19) Sodium nitrilotriacetate
(20) Sodium Cyclohexanediaminetetraacetate The beaching solution used in said processing can contain various additives besides the above organic acid salts. Such additives are especially desirable to include alkali or ammonium halide as a rehalogenating agent such as potassium bromide, sodium bromide, sodium chloride, and ammonium bromide; metal salts; and sequestering agents. The bleaching solution can contain also various other additives well-known as common bleaching solution additives, such as borates, oxalates, acetates, carbonates and phosphates as $_pH$ buffer agent; alkylamines; and polyethylene oxide compounds, as the case may be.

Further, the fixer or bleach-fix solution is allowed to contain, either singly or in combination of two or more kinds, $_pH$ buffer which is composed of such sulfites as ammonium sulfite, potassium sulfite, ammonium bisulfite, potassium bisulfite, ammonium metabisulfite, potassium metabisulfite, and sodium netabisulfite; boric acid, borax, sodium hydroxide, potassium hydroxide, ammonium hydroxide; such salts as sodium carbonate, potassium carbonate, sodium bicarbonate, potassium bicarbonate, and sodium acetate; acetic acid, and ammonium hydroxide.

When the bleach-fix processing is conducted while more bleach-fix solution is supplemented to the bleach-fix bath, such salts as thiosulfates, thiocyanates, and bisulfites are allowed to be contained by either said bleach-fix bath, or the supplementary bleach-fix solution.

In the invention, it is allowed, for the purpose of improving the activity of the bleach-fix solution, that air or oxygen is blown into either bath or storage vessel of the solution, or that a certain pertinent oxidizing agent such as hydrogen peroxide, bromate, and persulfate is added, as the case may be.

EXAMPLE

Each of Samples of silver halide color photo-sensitivity material listed in Table 1 was prepared that the following layers were applied on polyethylene resin-coated paper containing anatase titanium dioxide, in the described order. Each dose is represented as mg per 100 $cm^2$ of the paper.

Layer 1 . . . A layer which contains (1) 20 mg of gelatin, (2) blue-sensitive silver chlorobromide emulsion (5 mg as Ag), and (3) both 8 mg of Y-coupler, and 0.1 mg of 2.5-di-tert-octylhydroquinone dissolved in 3 mg of dioctyl phtholate.

Layer 2 . . . An intermediate layer which contains (1) 12 mg of gelatin, and (2) both 0.5 mg of 2,5-di-tert-octylhydroquinone, and 4 mg of UV absorber dissolved in 2 mg of dibutylphthalate.

Layer 3 . . . A layer which contains (1) 18 mg of gelatin, (2) green-sensitive silver chlorobromide emulsion (4 mg as Ag), and (3) 5 mg of M-coupler, 2 mg of antioxidant, and 0.2 mg of 2,5-di-tert-octylhydroquinone dissolved in 5 mg of dioctylphthalate.

Layer 4 . . . An intermediate layer with the same composition as Layer 2.

Layer 5 . . . A layer which contains (1) 16 mg of gelatin, (2) red-sensitive silver chlorobromide emulsion (4 mg as Ag), and (3) both 3.5 mg of C-coupler, and 0.1 mg of 2,5-di-tert-octylhydroquinone dissolved in 2.0 mg of tricresyl phosphate.

Layer 6 . . . A gelatin protective layer containing 9 mg of gelatin.

Each of Layers 1 to 6 was added by a certain coating aid, and each of Layers 4 and 6 was added by a certain gelatin cross-linking agent.

As a UV absorber for Layers 2 and 4, a mixture of the following UV-1 and UV-2 was used:

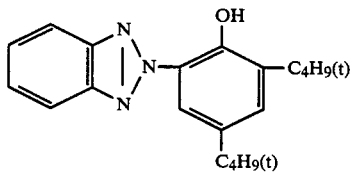

UV-1

-continued

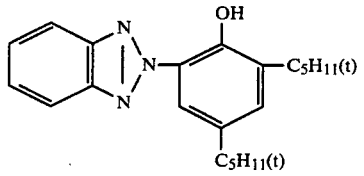

UV-2

As an antioxidant for Layer 2,5-tert-pentylhydroquinone dioctyl ether was used.

Each of the above multilayered photo-sensitive material was exposed to light through an optical wedge and was then developed according the following steps. The test results are shown in Table 1.

| (Developing Process) | | |
|---|---|---|
| Color developing | 38° C. | 3½ min. |
| Bleaching/fixing | 33° C. | 1½ min. |
| Stabilizing/washing | 25 to 30° C. | 3 min. |
| Drying | 75 to 80° C. | ca. 2 min. |

In each of the processing steps, the following processing solution was used. (Composition of Processing Solution)

| Color developer: | |
|---|---|
| Benzyl alcohol | 15 ml |
| Ethylene Glycol | 15 ml |
| Potassium sulfite | 2.0 g |

-continued

| | |
|---|---|
| Potassium bromide | 0.7 g |
| Sodium chloride | 0.2 g |
| Potassium carbonate | 30.0 g |
| Hydroxylamine sulfate | 3.0 g |
| Polyphosporic acid (TPPS) | 2.5 g |
| 3-Methyl-4-amino-N—ethyl-N—(β-methanesulfonamidoethyl) aniline sulfate | 5.5 g |
| OBA (4,4-Diaminostilbenedi sulfonic acid derivative) | 1.0 g |
| Potassium hydroxide | 2.0 g |
| Water to make | 1000 ml |
| (Adjust pH to 10.20 | |
| Bleach-fix solution: | |
| Ferri ammonium ethylenediamine tetraacetate dihydrate | 60 g |
| Ethylenediaminetetraacetic acid | 3 g |
| Ammonium thiosulfate, 70% soln. | 100 ml |
| Ammonium sulfite, 40% soln. | 27.5 ml |
| (Adjust pH to 7.1 with potassium carbonate or glacial acetic acid) | |
| Water to make | 1000 ml |
| Stabilizer: | |
| 5-Chloro-2-methyl-4-isothiazolin-3-on | 1.0 g |
| Ethylene glycol | 10 g |

TABLE 1

| | Layer 1 | Layer 3 | Layer 5 | | Light-resistance | | | |
|---|---|---|---|---|---|---|---|---|
| No. | Y-coupler | M-coupler | C-coupler | UV absorber | Y | M | C | Note |
| 1 | Y-5 | Ref. X-5 | C-(I)-1 | — | 72 | 30 | 75 | |
| 2 | Y-5 | Ref. X-5 | C-(I)-1 | UV-1, -2 | 81 | 47 | 85 | Layer 5 was further added by 2 mg of the UV absorber. |
| 3 | Y-5 | Inv. (17) | C-(I)-1 | — | 72 | 77 | 74 | |
| 4 | Y-5 | Inv. (17) | C-(I)-1 | UV-1, -2 | 80 | 86 | 88 | |
| 5 | Y-9 | Inv. (1) | C-(I)-3 | — | 74 | 78 | 81 | |
| 6 | Y-9 | Inv, (1) | C-(I)-3 | UV-1, -2 | 80 | 87 | 85 | |
| 7 | Y-9 | Inv. (1) | C-(I)-3 | UV-1, -2 | 86 | 94 | 90 | The same layer as Layer 2 was coated between Layers 5 and 6 of Sample 6. |
| 8 | Y-5 | Inv. (1) | C-(II)-1 | UV-1, -2 | 84 | 94 | 86 | The same layer arrangement as that of Sample 7 |
| 9 | Y-9 | Inv. (1) | C-(II)-4 | UV-1, -2 | 86 | 93 | 86 | The same layer arrangement as that of Sample 7 |
| 10 | Y-1 | Inv. (4) | C-(I)-1 | — | 70 | 78 | 74 | |
| 11 | Y-7 | Inv. (7) | C-(II)-4 | — | 71 | 79 | 72 | |
| 12 | Y-18 | Inv. (15) | C-(II)-10 | — | 73 | 80 | 71 | |
| 13 | Y-23 | Inv. (19) | C-(II)-1 | — | 71 | 78 | 70 | |
| 14 | Y-1 | Inv. (1) | C-(I)-5 | UV-1, -2 | 83 | 91 | 85 | The same layer arrangement as that of Sample 7 |
| 15 | X-1 | Inv. (1) | C-(I)-1 | | 35 | 77 | 75 | The same layer arrangement as that of Sample 10. |
| 16 | X-2 | Inv. (1) | C-(I)-1 | | 42 | 77 | 73 | The same layer arrangement as that of Sample 10. |
| 17 | X-3 | Inv. (1) | C-(I)-1 | | 38 | 76 | 73 | The same layer arrangement as that of Sample 10. |
| 18 | Y-5 | X-4 | C-(I)-1 | | 73 | 42 | 76 | The same layer arrangement as that of Sample 10. |
| 19 | Y-5 | X-6 | C-(I)-1 | | 72 | 35 | 74 | The same layer arrangement as that of Sample 10. |
| 20 | Y-5 | Inv. (1) | X-7 | | 72 | 78 | 30 | The same layer arrangement as that of Sample 10. |
| 21 | Y-5 | Inv. (1) | X-8 | | 73 | 76 | 35 | The same layer arrangement as that of Sample 10. |
| 22 | X-5 | Inv. (1) | X-9 | | 71 | 77 | 44 | The same layer arrangement as that of Sample 10. |
| 23 | X-1 | Inv. (1) | X-7 | | 34 | 76 | 30 | The same layer arrangement as that of Sample 10. |
| 24 | X-1 | X-5 | X-7 | | 34 | 31 | 28 | The same layer arrangement as that of Sample 10. |

The light resistance was determined in the following way:

The color-developed sample is irradiated for 5 days by a xenon fade meter. The percent residual dye is determined based on 1.0 for the initial density.

In the table, Y, M, C represent the light-sensitive of the dye images produced by yellow, magenta and cyan couplers, respectively.

$$\text{Light resistance} = \frac{\text{Density after irrad.}}{1.0} \times 100\ (\%)$$

(Reference coupler) X-1

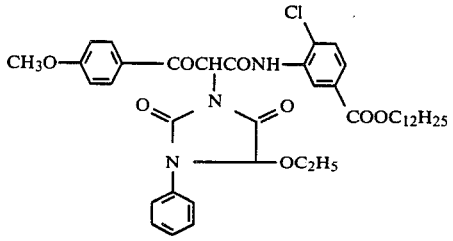

-continued (Reference coupler) X-2

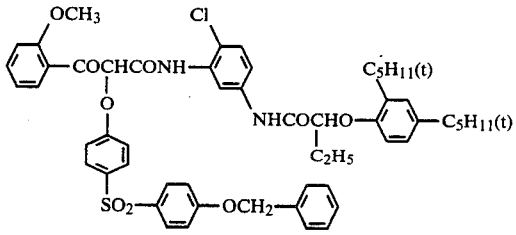

X-3

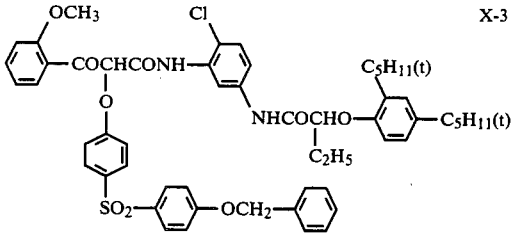

X-4

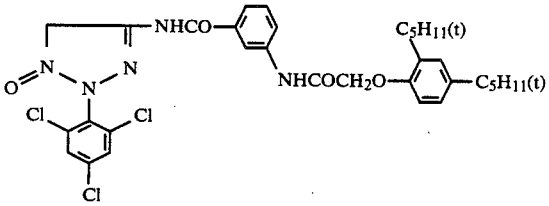

X-5

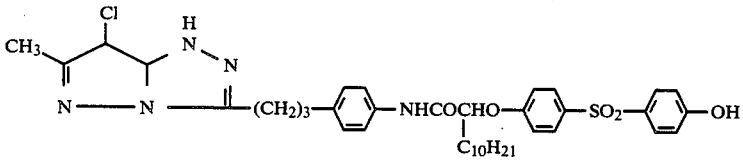

X-6

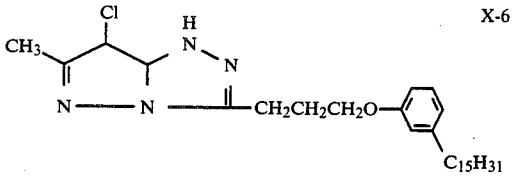

X-7

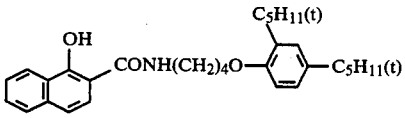

X-8

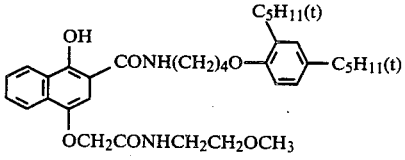

X-9

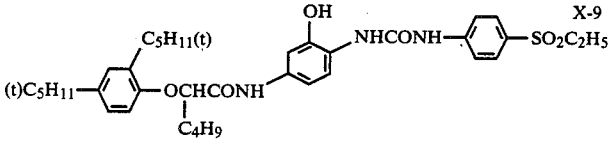

Formula (I)

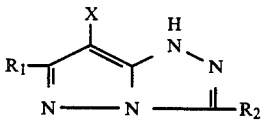

wherein $R_1$ represents a tertiary alkyl group; $R_2$ represents an alkyl group or an aryl group; and X represents a split-off group other than hydrogen, which is capable of splitting off through a reaction with the oxidation products of a color developing agent;

Formula (II)

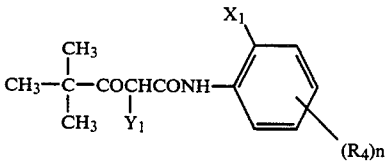

wherein $X_1$ represents a halogen, an alkoxy group or an alkyl group; $Y_1$ represents a group capable of splitting off when a dye is formed by coupling the group with the oxidation products of an aromatic primary amine As the obvious from Table 1, it can be proved that any combination of the yellow, magenta and cyan couplers of the invention may be able to display an excellent light-resistance and to stabilize the color-balance of a color-image formed in a color photographic light-sensitive material even when irradiated by light for a long period of time.

What is claimed is:

1. A silver halide color photographic light-sensitive material comprising a reflective support bearing thereon a green light-sensitive silver halide emulsion layer containing a magenta forming coupler represented by the following Formula (I); a blue light-sensitive silver halide emulsion layer containing a yellow-forming coupler represented by the following Formula (II); and a red light-sensitive silver halide emulsion layer containing a cyan-forming coupler represented by the following Formula (III) or (IV);

color developing agent; $R_4$ represents a group substitutable to a benzene ring; and n is an integer of 1 or 2;

Formula (III)

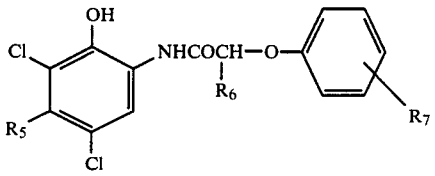

wherein $R_5$ represents an alkyl group having 1 to 4 carbon atoms; $R_6$ represents hydrogen or an alkyl group having 1 to 15 carbon atoms; and $R_7$ represents a halogen, an alkyl group, a hydroxy group or an acyloxy group;

Formula (IV)

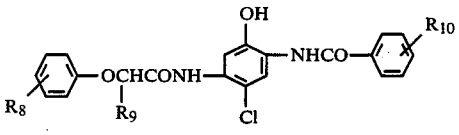

wherein $R_8$ represents an alkyl group, a halogen, a sulfonamido group, a sulfamoyl group, an arylsulfonyl group, or a hydroxy group; $R_9$ represents hydrogen or an alkyl group; and $R_{10}$ represents hydrogen, a halogen, an alkyl group, a sulfamoyl group or a sulfonamido group.

2. The silver halide color photographic light-sensitive material as claimed in claim 1, wherein X denoted in the Formula (I) represents a halogen atom.

3. The silver halide color photographic light-sensitive material as claimed in claim 1, wherein the alkyl group represented by $R_2$ in the Formula (I) has 1 to 32 carbon atoms.

4. The silver halide color photographic light-sensitive material as claimed in claim 1, wherein $Y_1$ denoted in the Formula (I) is represented by the following formula;

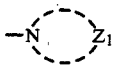

wherein $Z_1$ represents a group of atoms which is selected from the group of carbon, oxygen; nitrogen and sulfur atoms so as to form a 5- or 6-membered ring with the nitrogen atom in the formula.

5. The silver halide color photographic light-sensitive material as claimed in claim 1, wherein said cyan coupler is represented by the Formula (III).

6. The silver halide color photo-sensitive material as claimed in claim 1, wherein said teriary alkyl represented by $R_1$ is an alkyl group having a carbon atom directly coupled to the 1H-pyrazolo-3,2-c-S-trazole nucleus, said carbon atom having no hydrogen atom.

* * * * *